US005876276A

United States Patent [19]

Arbucci

[11] Patent Number: 5,876,276

[45] Date of Patent: Mar. 2, 1999

[54] COLLAPSIBLE CHIMNEY CAP

[76] Inventor: Christopher B. Arbucci, 359 Hickory St., Massapequa, N.Y. 11758

[21] Appl. No.: 928,172

[22] Filed: Sep. 12, 1997

[51] Int. Cl.[6] ..... F23L 17/02

[52] U.S. Cl. ..... 454/35; 454/12

[58] Field of Search ..... 454/3, 12, 35; 138/162

[56] References Cited

U.S. PATENT DOCUMENTS

| | | | |
|---|---|---|---|
| Re. 27,943 | 3/1974 | Smith . | |
| D. 246,464 | 11/1977 | Brazell . | |
| 462,127 | 10/1891 | Hanson . | |
| 494,454 | 3/1893 | Ashton . | |
| 555,643 | 3/1896 | Gordon . | |
| 678,083 | 7/1901 | Witte . | |
| 850,126 | 4/1907 | Bayley . | |
| 920,763 | 5/1909 | Lauritzen . | |
| 2,229,212 | 1/1941 | Kreutzer . | |
| 2,766,678 | 10/1956 | Morris . | |
| 2,821,900 | 2/1958 | Primich . | |
| 2,956,495 | 10/1960 | Sublette . | |
| 2,976,796 | 3/1961 | Anthony et al. . | |
| 3,089,521 | 5/1963 | Paiement . | |
| 3,173,354 | 3/1965 | Kinkead et al. . | |
| 3,232,207 | 2/1966 | Gibbons . | |
| 3,345,932 | 10/1967 | Sauer . | |
| 3,363,369 | 1/1968 | Miller . | |
| 3,363,538 | 1/1968 | Stoneman . | |
| 3,572,395 | 3/1971 | Burns, Jr. | 138/162 |
| 3,631,789 | 1/1972 | Kinsey . | |
| 3,685,426 | 8/1972 | Rosa . | |
| 4,007,759 | 2/1977 | Martin et al. . | |
| 4,023,374 | 5/1977 | Colbert et al. | 138/162 X |
| 4,202,255 | 5/1980 | McNamara . | |
| 4,334,460 | 6/1982 | Simmons et al. . | |
| 4,436,021 | 3/1984 | Hisey . | |
| 4,549,473 | 10/1985 | Alexander . | |
| 4,593,510 | 6/1986 | Newsome . | |
| 4,686,807 | 8/1987 | Newsome . | |
| 4,731,967 | 3/1988 | McLaughlin . | |
| 4,732,078 | 3/1988 | Giumenta et al. . | |
| 4,811,534 | 3/1989 | Newsome . | |
| 4,846,147 | 7/1989 | Townsend . | |
| 4,909,135 | 3/1990 | Greko . | |
| 4,955,167 | 9/1990 | Holtgreve . | |
| 5,003,739 | 4/1991 | Newsome . | |
| 5,125,199 | 6/1992 | Whitney et al. | 138/162 X |
| 5,402,613 | 4/1995 | Giumenta et al. | 454/12 X |

FOREIGN PATENT DOCUMENTS

| | | | |
|---|---|---|---|
| 2614675 | 11/1988 | France . | |
| 956494 | 4/1964 | United Kingdom | 138/162 |

OTHER PUBLICATIONS

"DUC–PAC Duct Packaged", Bulletin 654, Duc–Pac, Inc., East Longmeadow, Mass., 1956.

*Primary Examiner*—Harold Joyce
*Attorney, Agent, or Firm*—Baker & Botts, LLP

[57] ABSTRACT

A collapsible chimney cap which is stored in separate components and assembled at the point of installation. The connections between the separate pieces when assembled form smooth corners without external metal protrusions which could injure an installer or other person near the chimney cap. The chimney cap's connection mechanism also strengthens the assembled chimney cap by providing multiple points of connection. Each side piece has a insertion portion with internal protrusions which fits inside a receiving portion of an adjacent side piece. A roof is then attached the side pieces to complete the chimney cap.

14 Claims, 4 Drawing Sheets

COLLAPSIBLE CHIMNEY CAP

FIELD OF INVENTION

The present invention is directed towards a collapsible chimney cap which can be assembled at the site of installation.

BACKGROUND OF THE INVENTION

This invention relates to a chimney cap which is designed to be placed on top of and enclose the upper end of a chimney flue and prevent rain, hail, leaves, small animals and other possible obstructions from entering the chimney flue. Chimney caps also prevent birds and squirrels from nesting in an infrequently used chimney. Conventional chimney caps can be formed from a pliable metal material such as steel. The four walls are created by bending corners in single sheet of metal. The roof of the cap is typically welded on to form a single finished unit. In some chimney caps, flanges are welded to the bottom of each side to form a shelf by which the cap rests on top of the chimney. The cap can be further secured by screws on each side of the chimney cap in order to hold the cap in place next to the flue.

Most chimney caps are preassembled by the manufacturer to create a single unit consisting of four side pieces and a cap attached to the tops of the four side pieces. The manufactured caps when assembled are very bulky for purposes of both storage and shipment. A boxed assembled cap will take up large portions of shelf space in warehouses or retail stores or truck space when shipping. In addition, the assembled caps can be unwieldy for the installer of the cap who must bring the cap up a ladder to the rooftop of a dwelling with a chimney for installation. A chimney cap which is manufactured and shipped in smaller sections which can be easily assembled at the point of installation would be advantageous to both the seller and user of the cap.

One example of a collapsible cap which can be assembled at the point of installation is disclosed in U.S. Pat. No. 5,402,613 (the '613 patent). The '613 collapsible cap is made of four side panels with a roof attached to the top of the side panels. The sides illustrated are connected together by two interconnecting locking mechanisms for each side panel. Each side panel has two clips on one edge which are inserted into openings located on an adjacent side panel. A major drawback from the chimney cap described in the '613 patent is the existence of exposed clips which extend through the adjacent panels when locked together and which could injure the installer of the cap or a chimney cleaner while removing the cap. Additionally, the locking mechanism described in the patent limits the number of connection points between each of the side pieces to the number of clips manufactured into each side piece.

It would be advantageous to design a collapsible chimney cap which would eliminate sharp edges or clips after assembly and which would form a strong connection between the side portions by using the entire edge of the side portions in the connection instead of only isolated clips.

SUMMARY OF THE INVENTION

It is an object of the invention to create a collapsible chimney cap which does not have any exposed sharp metal edges which could harm an installer or other person near the chimney cap. It is a further object of the invention to provide a collapsible cap which has multitude connection points along each edge to strengthen the cap.

The collapsible cap is made of five prefabricated pieces (four side pieces and a roof) which are assembled together at the point of installation. Each side piece has a insertion portion and a receiving portion. The insertion portion is formed be bending one edge of the side piece to be approximately perpendicular to the plane of the side piece. Protrusions (or "notches") are then created in the bent edge. Each side piece has a receiving portion on the opposite edge of the side piece from the insertion portion. The receiving portion is formed by bending the edge to be approximately parallel with the plane of the side piece and then bending the end of edge back over onto itself so that a receptacle is formed. The tip of the edge is also bent back over onto itself to form a snap lock. The insertion portion of one edge is then connected to the receiving edge of an adjacent side piece with manual force. A roof can then be attached to the four side with rivets and timmerman nuts so that tools are not required.

BRIEF DESCRIPTION OF THE DRAWINGS

Further objects, features and advantages of the invention will become apparent from the following detailed description taken in conjunction with the accompanying drawings showing a preferred embodiment of the invention, in which.

DETAILED DESCRIPTION OF PREFERRED EMBODIMENTS

Figure 1:
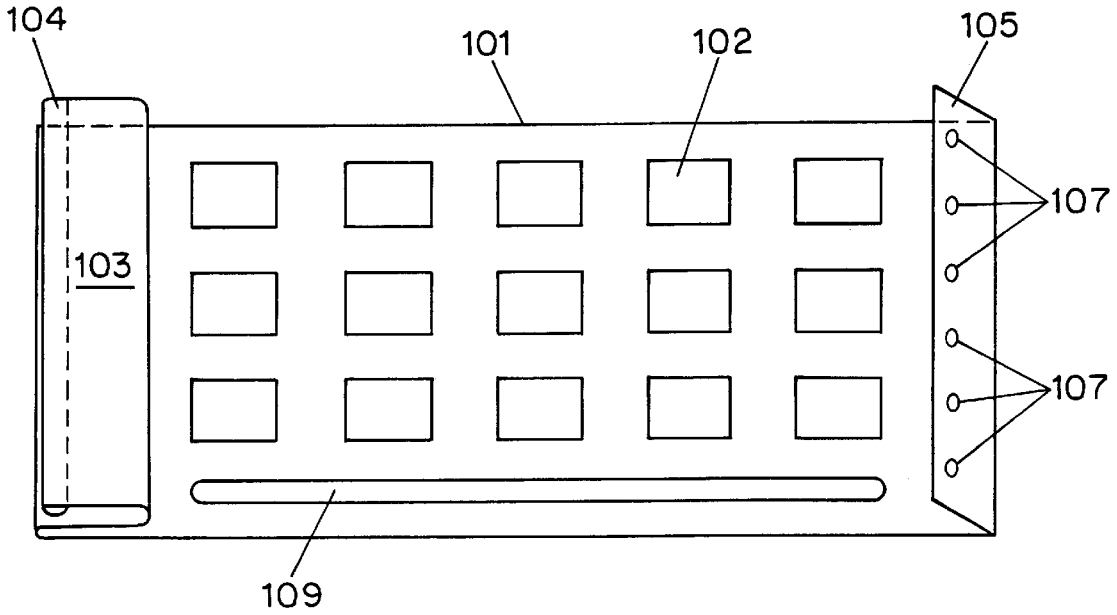
FIG. 1 shows a drawing of one of the side pieces of the collapsible chimney cap of the present invention.

The invention is directed to a collapsible chimney cap which can be assembled at the point of installation from pre-formed pieces without the need for tools and whose sides when connected form comers that do not contain metal protrusions which could injure an installer. The collapsible chimney cap of the present invention has multiple points of contact to secure the connection between the side pieces thus offering a strong cap when assembled that will not break apart due to inclement weather conditions (including strong winds) or the tampering of small animals or birds. The chimney cap side pieces are cut from a flat piece of material. The material is preferably steel but can be any other type of bendable material. The insertion portion ("tab") of each side piece is made by bending one of the two vertical edges of the side portions to form an insertion portion which is oriented perpendicular to the plane of the side piece. The insertion portion thus forms a right angle with main side portion. The other vertical edge for each side piece is then bent to create a receiving portion ("slot") for the side piece in the form of a female button snap lock (as further described below) and the other insertion portion of each side piece is worked to form protrusions in the insertion portion. The insertion portion will connect with the receiving end of an adjacent side piece. When two sides pieces are connected, the insertion portion of the first side piece is inserted into the receiving portion of the second side piece and the two are connected together by each protrusion snap lock with the receiving portion to form a secure connection. The insertion portion fits fully into the receiving portion leaving no outside metal edges exposed in making the connection. When the four side pieces are connected in this manner, the walls of the chimney cap form a smooth seamless connection from the outside and no metal protrusions remain which could injure the installer. Additionally, the protrusions or "buttons" present along the entire length of the flange give multiple points of contact to form a secure connection and which strengthens the overall cap. A roof is then affixed to the four walls by using rivets with timmerman nuts or by a conventional connector. The cap can be later disassembled by applying significant lateral force to the corner connections if and when the cap needs to be disassembled for further transportation (for example, if a person moves to another house with a chimney).

Five separate prefabricated pieces are assembled at the point of installation to make the collapsible chimney cap of the present invention. Four side pieces each include a receiving portion (described in detail in subsequent figures), an insertion portion (also described in detail in the subsequent figures) and attached flanges. The flange is present to aid in the stability of the cap when placed upon a chimney flue. A separate roof piece is attached to the top of the side pieces after they are assembled together. Rivets are used to attach the roof to the side portions and screws are used to further secure the side pieces to the chimney flue. In the preferred embodiment, a rivet (preferably rustproof) is used as the fastening device between the roof and the side walls using a timmerman nut which allows the installer to fasten the rivet by hand without requiring additional tools such as plyers. The rivet is simply pressed through the timmerman nut manually which is then held in place due to the design of the nut.

The attached flanges are preferably shorter than the length of each side wall so that the flanges will not contact each other when the side walls are connected together. The attached flanges will form a base which will cover the top of the chimney which is being covered and help keep the chimney cap in place. The flanges can also be substantially smaller than the length of each side wall while still providing a supporting base for the chimney cap. The collapsible chimney cap can alternatively be used as a cement down cap when the flue tile is recessed and will not support flanges. The end portions of the sides of the cap would be cemented to the chimney to hold it in place. In either case, the five prefabricated pieces and rivets are stored as separate pieces prior to assembly thus allowing the chimney cap to be packaged in a relatively flat box which can be more easily stacked or shipped.

FIG. 1 shows an expanded drawing of one of the side pieces. The other three pieces have the same configuration. The horizontal dimension of the side pieces are preferably the same in order to form a chimney cap with a square base. However, two of the side portions can also have a different common dimension to accommodate rectangular based chimney caps. The vertical dimension of the side pieces will vary based upon the chimney flue upon which the cap is placed. Side piece 101 includes holes (for example, hole 102) in the side piece for smoke to escape. Side piece 101 also includes a flange 109 which will form part of a base upon which the cap rests. Insertion portion 105 of side piece 101 shown extending out at approximately a right angle to the side piece contains protrusions 107 (formed by indentations in the flat metal) along the bent edge piece on the right hand side of FIG. 1. The number of protrusions depends upon the physical size of the insertion portion and the strength of the chimney cap material. The more indentations which are present, the stronger the connection made between two adjacent side pieces. For example, a chimney cap made from stainless steel material having a connection portion with a length of twelve inches will preferably be made with six indentations. However, a different numbers of protrusions can be used depending upon the type of metal and other requirements in accordance with the invention.

Receiving portion 103 of side piece 101 shown in FIG. 1 is created by bending the side portion 101 in the particular manner described below. The left edge portion of side piece 101 in FIG. 1 is bent over back onto itself forming a double layer. The top layer of double layer is then again bent over onto of itself so that the bent layers form a "Z" with the open portion of the resultant piece facing outward. The end tip of metal sheet edge is then bent back over upon itself to form a curved edge 104 and create a ridge (or "notch") within the open portion so that a protrusion (or "bubble") will catch the ridge forming a secure connection.

Figure 2:
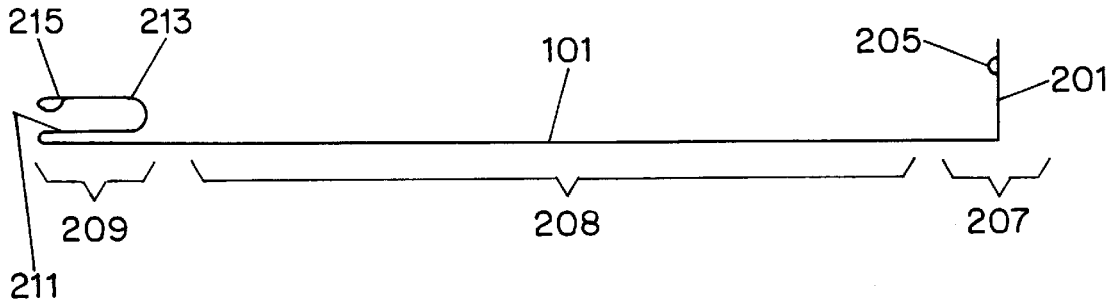
FIG. 2 shows a bottom view of one of the side pieces of the collapsible chimney cap.

FIG. 2 shows a bottom view of side piece 101. The bottom view shows the proper bends formed in the metal material for each side piece. The insertion end portion 207 is formed by bending the outside edge 201 of side piece 101 to be approximately perpendicular with the main side plane 208. Protrusions 205 are formed along the inside surface of outside edge 201. The bending and protrusion forming steps can be performed in any order either manually or by machine as long as the result of the manufacturing steps forms the pieces described herein. However, the preferred order is forming the outside small bends first in order to properly make all the bends.

The receiving end portion 209 of side piece 101 is formed by bending the outside edge 211 back to be approximately parallel with the plane of the main side piece 208. The end portion 213 of outside edge 211 is then bent forward on top of itself to form an opening facing outward in which the insertion portion 207 of another side piece will be inserted. Finally, the tip of the edge piece 213 is shown folded back onto itself to create a notch 215 in the opening. This allows the protrusion 205 from another edge piece to be pushed past the notch 215 and be held in place. The bending processes described can be performed in any order as long as the resultant shape described herein is formed.

Figure 3:
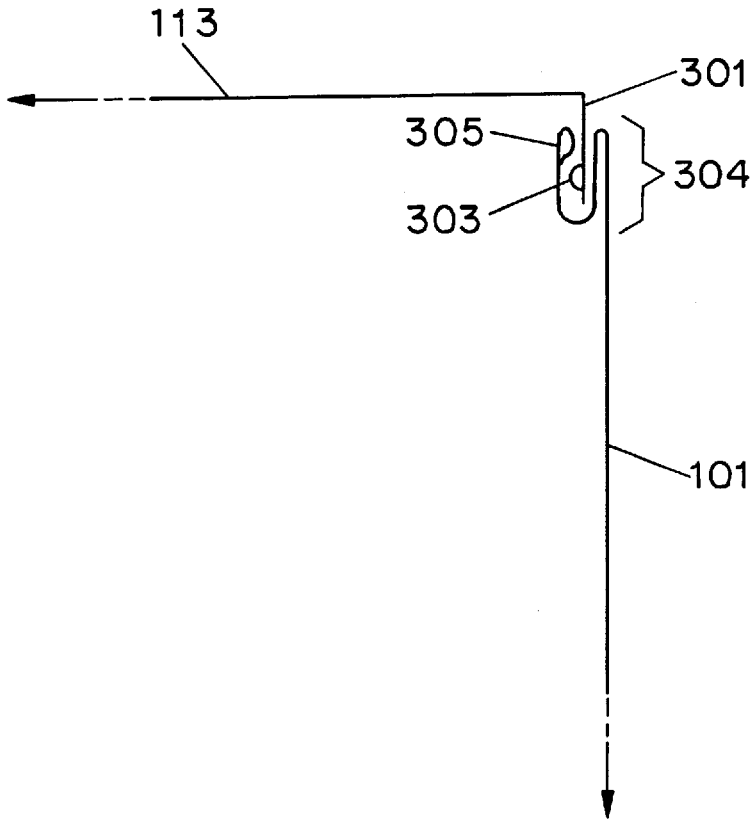
FIG. 3 shows the top view of a connection between two adjacent side pieces of the collapsible chimney cap.

FIG. 3 shows a top view of the connection of two side pieces 101 and 103 of the chimney cap when assembled. These connections are made between any two adjacent side pieces in the cap. Side piece 101's receiving portion is shown in the figure and side piece 103's insertion portion is shown in the Figure. The perpendicular edge 301 with protrusions 303 are inserted into receiving end portion 304. The protrusion 303 is slipped past the edge of receiving portion 305 so it cannot be removed without significant applied lateral force and as a result the insertion portion of side piece 103 is fixed securely in the receiving portion of side piece 101. Multiple protrusions along the insertion edge 301 hold the two sides in place. The insertion edge 301 is safely surrounded by the receiving means which leaves no sharp edges exposed on the chimney cap after assembly. The two sides shown are also connected together by multiple protrusion points along the invention edge portion which makes the attachment much stronger than if only one or two connection points were present for each side.

Figure 4:
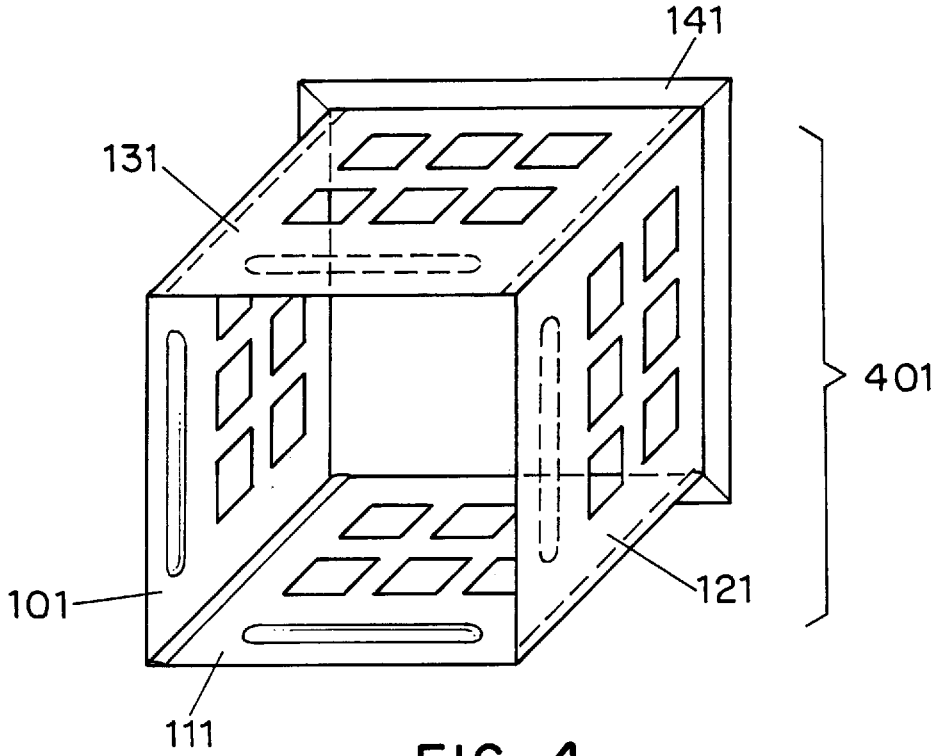
FIG. 4 shows a collapsible chimney cap which has been assembled.

FIG. 4 shows a chimney cap assembled from the prefabricated pieces. Each side piece 101, 111, 121 and 131 is connected with two other sides pieces to form either a square or rectangular housing (depending on the dimensions of the sides) for the chimney cap. Each of sides includes an attached flange to form a base to hold the chimney cap onto of the chimney. The roof 141 is attached to the assembled four sides to complete the cap. Rivets with timmerman nuts can be used without the assistance of tools to affix the roof to the four walls. The assembly chimney cap 401 then rests on the chimney top and can be further secured with set screws located near the bottom of the side portions which will hold the chimney cap in place.

FIG. 5A, 5B, 5C and 5D show alternate embodiments of the collapsible chimney cap made in accordance with the invention. FIG. 5A–5D show bottom views of individual side pieces with different configurations for their receiving portions (slots) and their insertion portions (tabs). Side piece 501 shows an insertion portion 505 which is oriented in the same direction as the main portion of side piece 501 of FIG. 5A. Additional bends are not required to form insertion portion 505 except to make the necessary protrusions. Receiving portion 503 is oriented at approximately a right angle to the main portion of side piece 501. When other side pieces with similar constructions are connected together, they will form a rectangular (or square) chimney cap base.

Figure 5A:
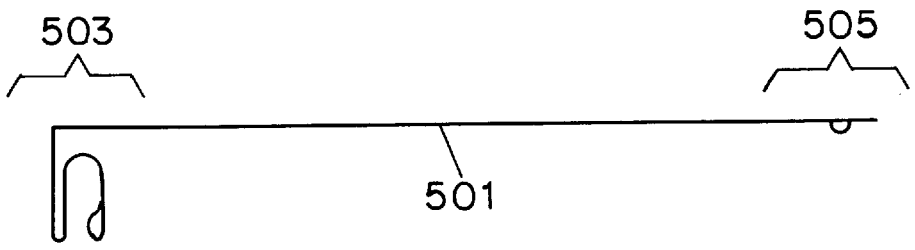
FIGS. 5A–5D show bottom views of alternate embodiments of side pieces in accordance with the invention.
Figure 5B:
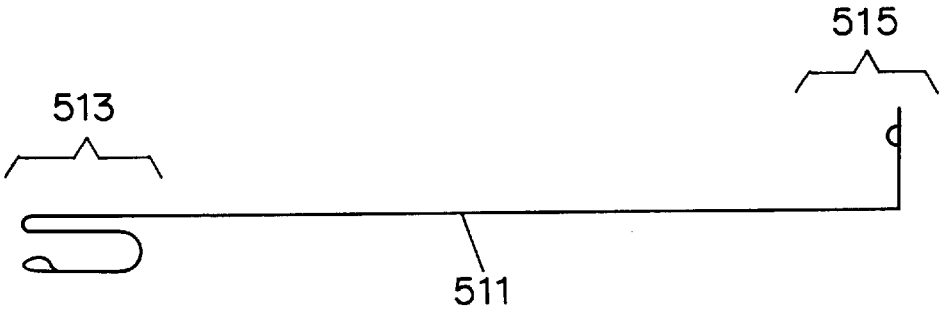

Side piece 511 of FIG. 5B shows an embodiment in which the receiving portion 513 is formed on the outer surface of side piece 511. The outer surface is designated by which side of the side piece will be facing outward after the four side pieces have been joined together. When compared to side piece 101 in the preferred embodiment, the location of the receiving portion is shown on the opposite side of the main portion of the side piece. The insertion portion 515 is oriented approximately perpendicular to the main side piece as in side piece 101.

Figure 5C:
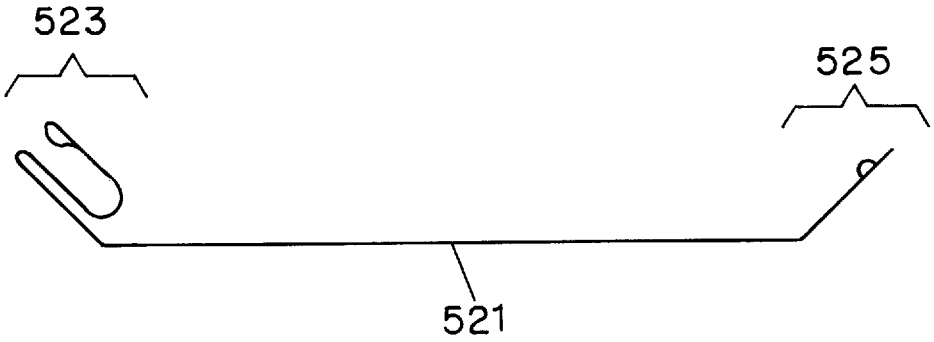

Side piece 521 of FIG. 5C shows another embodiment of the present invention. Side piece 521 has a receiving portion 523 which is oriented approximately 45 degrees from the main portion of side piece 521. The insertion portion 525 is also oriented approximately 45 degrees from the main portion of side piece 521. When four side pieces constructed in this manner are connected together, a rectangular (or square) base will be formed with beveled corners.

Figure 5D:
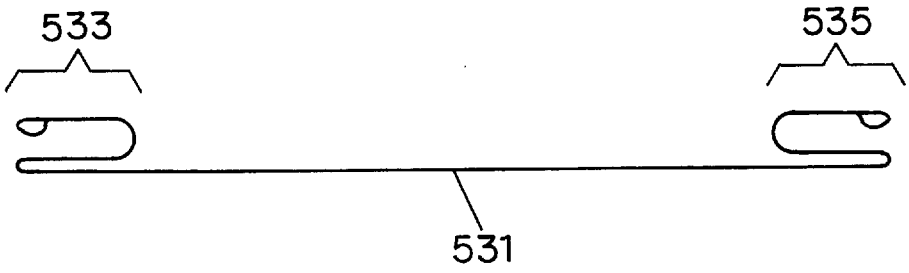

Side piece 531 of FIG. 5D shows yet another embodiment with a side piece 531 with two receiving portions 533, 535. In this embodiment, two side pieces each with two receiving portions would be connected with two other side pieces each with two insertion portions. The side pieces containing two insertion portions would have the insertion portion shown as insertion portion 207 be located on both end of the side piece. The four pieces constructed in this manner can be connected together to form corner connection and create a rectangular (or square) chimney base. Any combination of insertion portions and receiving portions shown in FIG. 5A–5D or FIG. 2 which would form comer connections in accordance with the present invention can be used.

Figure 6:
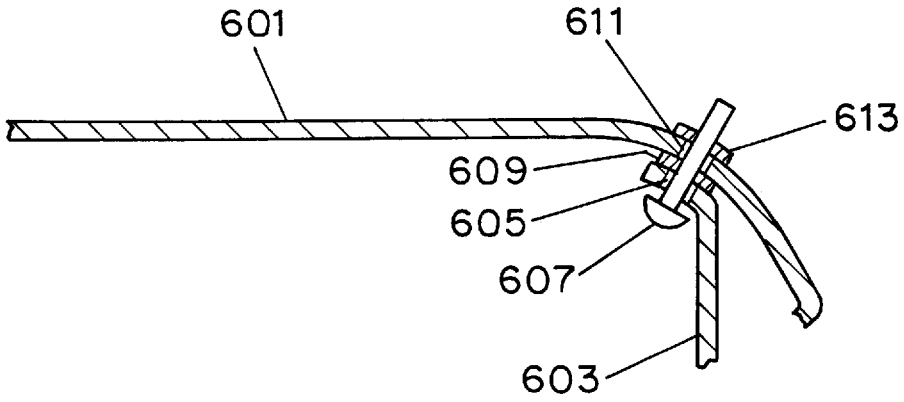
FIG. 6 shows a cross section of the connection made between a side piece and the chimney roof.

FIG. 6 shows a cross section of the portion of the chimney cap containing the connection between a side piece and the roof piece when the collapsible chimney cap is assembled. Roof piece 601 is situated on top of the side pieces after the side pieces are joined together in accordance with the invention. Side piece 603 shows the top of a side piece bent such that the adjacent portion of the roof piece will be approximately flush to the top of the side piece as shown. A hole 605 is made in the top of each side piece into which a rivet, preferable rust proof, is inserted. A timmerman nut is placed over the end of the rivet and slid down the bolt so that it is adjacent to the outside of the top of the side piece. The timmerman nut 609 thus holds the rivet in place when the side piece is being stored separately or shipped prior to assembly. At the point of installation, the roof portion which also contains a hole 611 is placed such that the rivet 607 goes through the hole 611. After the rivet is slid through the hole 611, a second timmerman nut 613 which is shipped with the other pieces is placed on the outside of the rivet to hold the roof piece in place. By holding the rivet in place prior to assembly, the assembly process is made simpler and the problem of lost small connecting pieces is resolved.

The side pieces of the present invention can be bent in a series 900 roll former manufactured by Engel Industries which can be specially configured to make the bends described herein. The metal used is preferably steel between 2 and 28 gauge (although other gauges can also be used) and the horizontal length of the receiving portion is preferably one half inch. The horizontal length of the insertion portion is preferable 7/16 of an inch corresponding to the ½ inch receiving portion. This allows the insertion edge to be fully pushed into the receiving portion and held in place by the protrusion on the insertion portion and the snap lock on the receiving portion. The roof piece can also be formed using conventional means. The resultant prefabricated side pieces and a roof piece which can be stored and shipped prior to assembly and which form safe and firmly connected corners when assembled at the point of installation.

The foregoing merely illustrates the principles of the invention. It will thus be appreciated that those skilled in the art will be able to devise numerous systems, apparatus and methods which, although not explicitly shown or described herein, embody the principles of the invention and are thus within the spirit and scope of the invention as defined by its claims.

For example, different materials such as composite plastic can also be used to create the pieces for the collapsible chimney cap. The plastic could be molded in the form in accordance with the invention. Additionally, other malleable materials could be used and bent into the proper form.

I claim:

1. A collapsible chimney cap comprising:

a plurality of side pieces wherein each side piece comprises a first edge bent to form a receiving slot, and a second edge bent to form an insertion tab, wherein said insertion tab of each side piece fits inside said receiving slot of an adjacent side piece to form a corner connection to assemble said cap; and a roof adapted to be attached to said assembled side pieces, wherein said first edge of said insertion tab is bent approximately perpendicular to said side piece's main position and includes a plurality of protrusions.

2. The chimney cap according to claim 1, wherein said protrusions number three or more.

3. The chimney cap of claim 1, wherein each said second edge of said pieces is bent approximately parallel to the main portion of said side piece and is further bent back over said main portion to create an opening for said slot.

4. The chimney cap of claim 3, wherein said receiving slot includes a snap lock formed in said second edge.

5. The chimney cap of claim 1, wherein an attachment means is coupled to each said side piece prior to said assembly of said cap and said attachment means is used to attach said roof.

6. The chimney cap of claim 1, wherein each said side piece comprises a flange and said flanges form a base when said cap is assembled.

7. A collapsible chimney cap comprising:

a housing having four side pieces which are detachably connected to one another in succession, each of said sides comprising a first edge bent approximately perpendicular to said side and having a plurality of protrusions formed in said first edge, wherein each of said sides further comprises a second edge bent to form a receiving slot for said first edge of another said side piece and wherein said first edge fits inside said receiving slot of another said side piece to form said connection; and a roof attached to said housing, wherein said second edge includes a snap lock to hold in said protrusions of said first edge.

8. The chimney cap of claim 7 wherein said receptacle comprises said second edge bent approximately parallel over the main portion of said side piece which is further bent back over said main portion to create an opening of said slot which faces outward.

9. The chimney cap of claim 8, wherein at least one said protrusions of said first edge locks into said receptacle of an adjacent said side.

10. The chimney cap of claim 7, wherein said roof is attached to said side pieces with at least a timmerman nut.

11. A collapsible chimney cap comprising:

a first pair of side pieces, wherein each side piece in said first pair comprises a first edge bent to form a receiving slot and a second edge bent to form a receiving slot, a second pair of side pieces wherein each side piece in said second pair comprises a first edge bent to form an insertion tab and a second edge bent to form an insertion tab, wherein each said insertion tab of said second pair fits inside one of said receiving slots of said side pieces of said first pair to form a corner connection to assemble said cap; and a roof adapted to be attached to said assembled side pieces, wherein each said insertion tab comprises a first edge of said side piece which is bent approximately perpendicular to said side piece's main position and includes a plurality of protrusions.

12. The chimney cap according to claim 11, wherein said protrusions number three or more.

13. The chimney cap of claim 11, wherein each said receiving slot comprises a second edges bent approximately parallel to the main portion of said side piece which is further bent back over said main portion to create an opening of said slot which faces outward.

14. The chimney cap of claim 13, wherein said receiving slot includes a snap lock formed in said second edge.

* * * * *